US006120362A

United States Patent [19]

Etter et al.

[11] Patent Number: 6,120,362

[45] **Date of Patent: *Sep. 19, 2000**

[54] ERGONOMIC GRINDER

[75] Inventors: Mark A. Etter; John C. Smith, both of Jackson, Tenn.

[73] Assignee: Porter-Cable Corporation, Jackson, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/871,447

[22] Filed: Jun. 9, 1997

[51] Int. Cl.[7] ..... B24B 23/02

[52] U.S. Cl. ..... 451/354; 451/358; 451/359

[58] Field of Search ..... 451/344, 354, 451/358, 359; 15/79.1, 143.1; 16/110 R

[56] References Cited

U.S. PATENT DOCUMENTS

| | | | |
|---|---|---|---|
| D. 347,153 | 5/1994 | Uneyama . | |
| D. 364,790 | 12/1995 | Duennes . | |
| D. 385,467 | 10/1997 | Schweizer . | |
| D. 386,378 | 11/1997 | Henssler et al. . | |
| 2,088,330 | 7/1937 | Madsen | 451/359 |
| 2,101,305 | 12/1937 | Albertson | 451/359 |
| 2,166,757 | 7/1939 | Forss | 451/359 |
| 4,016,684 | 4/1977 | Urda | 451/344 |
| 4,177,532 | 12/1979 | Azuma . | |
| 4,558,539 | 12/1985 | Hansson | 451/344 |
| 4,643,263 | 2/1987 | Karden . | |
| 4,772,186 | 9/1988 | Pyles et al. . | |
| 5,125,189 | 6/1992 | Holmin et al. | 451/344 |
| 5,228,244 | 7/1993 | Chu | 451/344 X |
| 5,601,483 | 2/1997 | Rudolf et al. | 451/359 |
| 5,636,698 | 6/1997 | Estep et al. . | |
| 5,637,034 | 6/1997 | Everts et al. | 451/344 |
| 5,664,634 | 9/1997 | McCracken . | |
| 5,701,961 | 12/1997 | Warner et al. . | |

OTHER PUBLICATIONS

DeWalt Angle Grinders Brochure (1 pg.).

Milwaukee® Operator's Manual, catalog Nos. 6148 and 6151, Heavy–Duty Sanders/Grinders (27 pgs.).

*Primary Examiner*—Timothy V. Eley

*Attorney, Agent, or Firm*—Merchant & Gould P.C.

[57] ABSTRACT

The present disclosure relates to an angle grinder including an elongated handle body having front and rear portions. The handle body has a greater nominal width proximate the front portion than proximate the rear portion. A recessed hand grip portion is defined by the handle body between the front and rear handle portions. The recessed hand grip portion transitions inward to a nominal girth that is smaller than the girth of both the front and rear portions. The recessed hand grip portion also includes a leading front wall that transitions from the smaller nominal girth of the grip portion toward the larger nominal girth of the front portion. The leading front wall is aligned at an angle that slopes in a forward direction as the leading front wall extends from the top side toward the bottom side of the handle body. The disclosure also relates to an angle grinder having a switch paddle pivotally connected to a handle. The switch paddle is sized and shaped to fit within a recess defied by the handle so as to form an integral part of the handle. The disclosure further relates to an angle grinder having a switch paddle equipped with an intermediate finger stop protrusion sized for supporting a user's finger.

29 Claims, 12 Drawing Sheets

ERGONOMIC GRINDER

BACKGROUND AND SUMMARY OF THE INVENTION

The present application relates to an ergonomic grinder having a handle body with an elongated shape and having front and rear handle portions defined by the handle body. The handle body has a greater nominal girth proximate the front portion than proximate the rear portion. A recessed hand grip portion is defined by the handle body and is located between the front and rear handle portions. The recessed hand grip portion transitions inward to a nominal girth smaller than the girth of both the front and rear portions. The recessed hand grip portion is preferably configured to create a home feel to a user's hand.

In one embodiment of the present grinder, the recessed hand grip portion comprises a recessed portion located generally under the handle body, and the handle comprises a switch paddle located generally under the handle and being coupled to the handle by a pivotal connection located proximate the rear handle portion. In this embodiment, the switch paddle is pivotably depressable about the pivotal connection in a direction toward the underside of the grinder for activation and use of the tool. The switch paddle comprises a recessable portion, and the grinder and recessable portion of the switch paddle are configured so that the recessed hand portion of the tool handle substantially conforms to the shape and thickness of the recessable portion of the switch paddle. The recessable portion of the switch paddle, when fully depressed for activation and use of the tool, fits within the underside recessed hand portion of the grinder and becomes essentially an integral part of the grinder as perceived by the feel of a tool user's hand.

In embodiments of the present grinder comprising a switch paddle, the switch paddle preferably comprises a finger stop section which is located on the underside of the switch paddle and which comprises a generally downward-facing protrusion. The downward-facing protrusion is oriented generally crosswise to the length of the switch paddle. In this embodiment, the user of the grinder can selectively place fingers forward or rearward of the finger stop section as part of adjusting the user's hand and finger positions during use of the tool.

The above and other embodiments of the present invention will be further described below through the use of the Figures, which are intended only to illustrate preferred embodiments while in no way limiting the breadth of the present invention.

DESCRIPTION OF THE PREFERRED EMBODIMENTS

Figure 1:
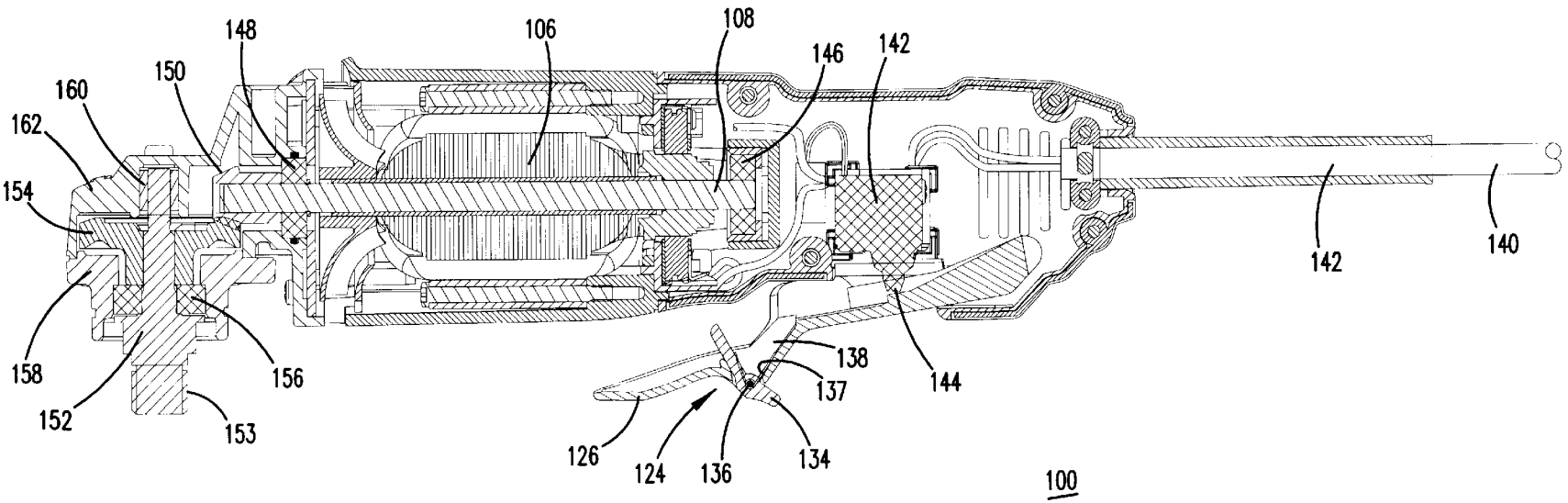
FIG. 1 is a cross-sectional view of a grinder having a switch paddle in a lowered position.

The present invention is a grinder 100 which comprises a handle body 102 having an elongated shape and having front 110 and rear 112 portions defined by handle body 102. The handle body has a greater nominal girth proximate front portion 110 of the handle body than proximate rear portion 112. The present grinder 100 typically includes a recessed hand grip portion 114, which is defined by the handle body, which is located between the front and rear handle portions, and which transitions inward to a nominal girth smaller than the girth of both the front and rear portions. Recessed hand grip portion 114 creates a home feel to a user's hand.

The present grinder is preferably adapted and configured to provide multiple ambidextrous holding positions for a user's hand.

In one embodiment of the present grinder, recessed hand grip portion 114 is defined by the handle body to have a leading front wall 116 which transitions from the smaller nominal girth of recessed hand grip portion 114 toward the larger nominal girth of front portion 110 and a trailing back wall 118 which transitions from the smaller nominal girth of recessed hand grip portion 114 toward the larger nominal girth of rear portion 112. In this embodiment, the angled front and back walls of the recessed hand grip portion create an enhanced home feel to the user's hand. As is shown in the Figures, leading front wall 116 is defined by handle body 102 to have an angled orientation 120 which slopes continuously in a downward direction toward the front handle portion. Preferably, the slope of angle 120 conforms to natural ergonomic grip angles of the user's hand. In the preferred embodiment illustrated, angle 120 is approximately 12 degrees. Leading front wall 116 may be formed so that the user's hand can push forward against it.

As previously indicated, recessed portion 114 of handle body 102 preferably also includes a trailing back wall 120 defined by the handle body to have an orientation which slopes in a downward direction toward the front handle portion at an angle 122. This trailing back wall preferably also is formed to natural ergonomic grip angles of the user's hand. Accordingly, preferably both the leading front wall 116 and the trailing back wall 118 are defined to have an angle which slopes in a downward direction toward the front handle portion. In the embodiment shown, the leading front wall and trailing back wall are substantially parallel to one another, such that angles 120 and 122 are approximately equal.

Preferably, grinder 100 is adapted and configured to provide a home feel to no fewer than five multiple holding positions of the user's hand. These five holding positions can be selected by the user through selectively placing anywhere in the range from no fingers to all four fingers ahead of a finger stop 124 located on switch paddle 126, which will now be discussed.

The present grinder may also be configured with a switch paddle 126 located generally under grinder 100 and being coupled to handle 102 by a pivotal connection located proximate the rear handle portion. In such an embodiment, switch paddle 126 is pivotally depressable about the pivotal connection in a direction toward the underside of the grinder for actuation and use of the tool.

In a preferred combination of recessed handle portion 114 and switch paddle 126, the recessed handle portion includes a recessed underside region 128 located between the front and rear handle portions. Preferred switch paddle 126 comprises a recessable portion 130 sized so that the lower recessed portion 128 of the grinder substantially conforms to the shape and thickness of the recessable portion 130 of the switch paddle. Accordingly, in this embodiment of the present invention, recessable portion 130 of switch paddle 126, when fully depressed for activation and use of the tool, fits within underside region 128 of recessed handle portion 114 and becomes essentially an integral part of the tool handle as perceived by the feel of the tool user's hand. This essentially integral fit between the underside region 128 of recessed handle portion 114 and recessable portion 130 of switch paddle 126 can be seen in all of the Figures in which switch paddle 126 is shown fully depressed for activation and use of tool grinder.

Switch paddle 126 is preferably configured to comprise a finger support portion 132 long enough to support essentially all four fingers of a typical user's hand. In this embodiment, the switch paddle, when held with all four fingers of the user's hand, spreads out finger contact loading, thus reducing pressure points over conventional, smaller trigger designs, while also providing the advantage of including the recessable portion which, as previously noted, when depressed, becomes essentially an integral part of tool handle 102 as perceived by the feel of a tool user's hand, thus providing further comfort for the user.

As previously indicated, the grinder, handle and switch paddle preferably are adapted and configured to provide multiple ambidextrous holding positions of the user's hand. In this regard, the present switch paddle preferably defines a finger stop section, which is located on the underside of the switch paddle and which comprises a generally downward-facing finger stop protrusion 124. Finger stop protrusion 124 is oriented generally crosswise to the length of switch paddle 126 so that the user of the tool can selectively place fingers forward or rearward of the finger stop section as part of adjusting the user's hand and finger positions during use of the tool. In a preferred embodiment, protrusion 124 is located approximately in the middle along the length of switch paddle 126.

The protrusion of the preferred switch paddle typically comprises a switch lock lever 134 having a locked-off position which prevents depression of the switch paddle. For the embodiment illustrated, the locked-off position of switch lock lever 134 is shown in all of the Figures in which switch paddle 126 is shown in the downward-most position (see FIGS. 1, 3–9, and 17). Switch lock lever 134 also has an operational position permitting depression of the switch peddle and activation of the tool. The operational position of switch lock lever 134 is shown for the illustrated embodiment in all of the Figures in which switch paddle 126 is fully depressed toward tool handle 102 for activation and use of the tool (see FIGS. 10–16 and 18).

In a preferred embodiment, switch lock lever 134 is pivotably coupled by a lock pin 136 to finger stop protrusion 124 proximate the lower portion of the finger stop protrusion, and the switch lock lever comprises an elongated member which, in the locked-off position, protrudes from pivotal coupling 136 toward the grinder and from pivotal coupling 136 downward or away from the switch paddle and grinder 100. In the embodiment shown, switch lock lever is biased toward the locked-off position by a torsion spring 137. With this embodiment, switch lock lever 134 is pivotably moveable by fingers of the user's hand to an operational position, permitting depression of the switch paddle and activation of the grinder. In the embodiment shown, switch lock lever 134 is pivotal to the operational position by pushing the lower portion of switch lock lever 134 toward the front of the tool, thus creating a pivoting motion of the upper portion of pivotal lock 134 into a hollow portion 138 within switch paddle 126 (see FIG. 1).

The present grinder may be powered by any type of motor, such as an electrical motor run by line power through a line cord 140 (which may be secured to the tool with a cord set reinforcing member 142) or by a battery-powered electrical motor, or an air motor.

FIG. 1 illustrates a typical configuration of a grinder 100 which incorporates ergonomic handle 102. The grinder shown operates through line electrical power connected through cord 140 and through a push button switch 142 to motor 106. In the embodiment shown, push button switch 142 comprises a lower button 144 which interfaces with the upper side of switch paddle 126 such that, when switch paddle 126 is pivotably depressed toward grinder, button 144 of switch 142 is depressed inward toward the switch in order to activate the switch and permit current to be delivered to motor 106.

The particulars of the motor and drive train for providing an output to a grinding disk 146 (or to a sanding disk, buffing pad, or other accessory) may be by any conventional means. In the embodiment illustrated, motor 106 drives a motor armature shaft 108 which is secured within housings 102 and 104 in an orientation generally parallel to the elongated length of housings 102 and 104. In the embodiment illustrated, armature shaft 108 rides in ball bearings 146 and 148, and armature shaft 108 on its output end comprises a bevel pinion gear 150 which in turn drives output shaft 152 through an interface with bevel gear 154. Output shaft 152 is essentially perpendicular to motor armature shaft 108 in the embodiment shown and is held rotatably in place through a ball bearing 156 secured in lower gear housing 158 and through a needle bearing 160 secured in upper gear housing 162.

When using a grinder such as the one illustrated, motor 106 is connected to a power source, and the tool itself is firmly grasped to resist starting torque of the motor. To start grinder 100, the user pushes forward on the lower portion of switch lock lever 134 while at the same time squeezing switch paddle 126 toward the tool. This activates switch 142 and engages the motor. To stop the grinder, switch paddle 126 is released, allowing it to return to its downward off position away from grinder 100. When the user releases switch paddle 126 and is no longer biasing forward the lower portion of switch lock lever 134, the switch lock lever automatically is moved to its locked-off position by torsion spring 137, thus preventing inadvertent activation of the tool. When a user releases switch paddle 126 to stop the tool, machine spindle or output shaft 152 and the corresponding attached accessory 146 should be allowed to stop rotating before placing the machine down, such as on a workbench.

As part of using grinder 100, auxiliary handle 164 may be installed on either side toward the top of the front housing, through a threaded spindle on handle 164, which threads into threaded apertures 166 defined by the tool housing.

In the embodiment shown, a wheel guard 168 should be installed and properly oriented so that it is positioned between the user and wheel or accessory 146, so that flying chips or pieces that might break off will be deflected away from the user.

Guard 168 may be attached and positioned by disconnecting the tool from its power source, resting the machine on its back with spindle or output shaft 152 facing up and positioning the guard onto the mounting flange of the housing, as illustrated in the Figures. Prior to tightening securing screw 172 of the guard securing clamp 174, guard 168 should be rotated to a position that will place the guard between the operator and wheel 146 (or other accessory requiring a guard). Clamp screw 172 is then tightened to secure the guard into proper position.

Grinding wheels 146 or other accessories typically are attached to threads 153 of output shaft or spindle 152, by disconnecting the tool from its power source, resting the machine on its back with the spindle facing up, and installing the appropriate wheel 146 or other accessory onto the threaded end of upward shaft 152. During this process, a depressable spindle lock 174 is typically used to prevent the spindle from rotating while tightening the accessory to the output spindle. Accessories such as grinding wheels 146 are typically installed with a threaded retaining nut 176 using a spanner wrench (not shown) to thread the retaining nut in place using apertures 178 to engage the wrench.

Figure 2:
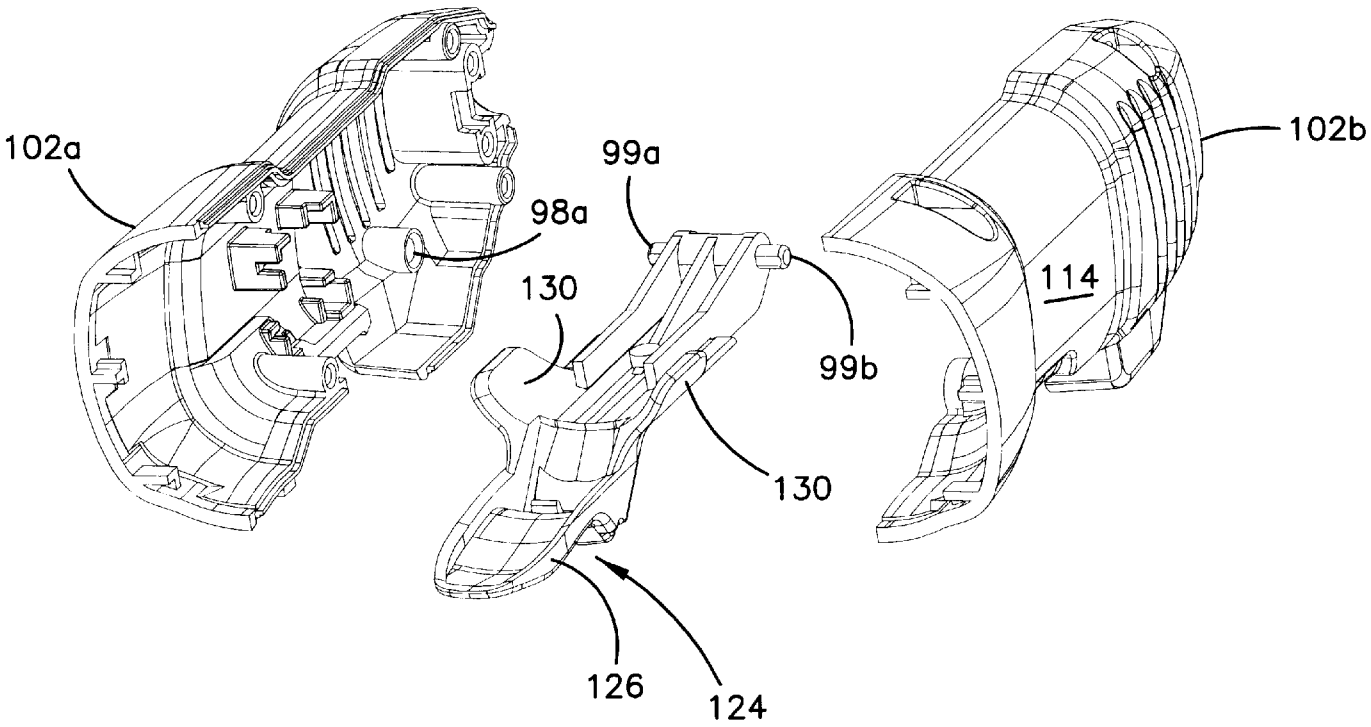
FIG. 2 is an exploded view of a handle housing and a switch paddle.
Figure 3:
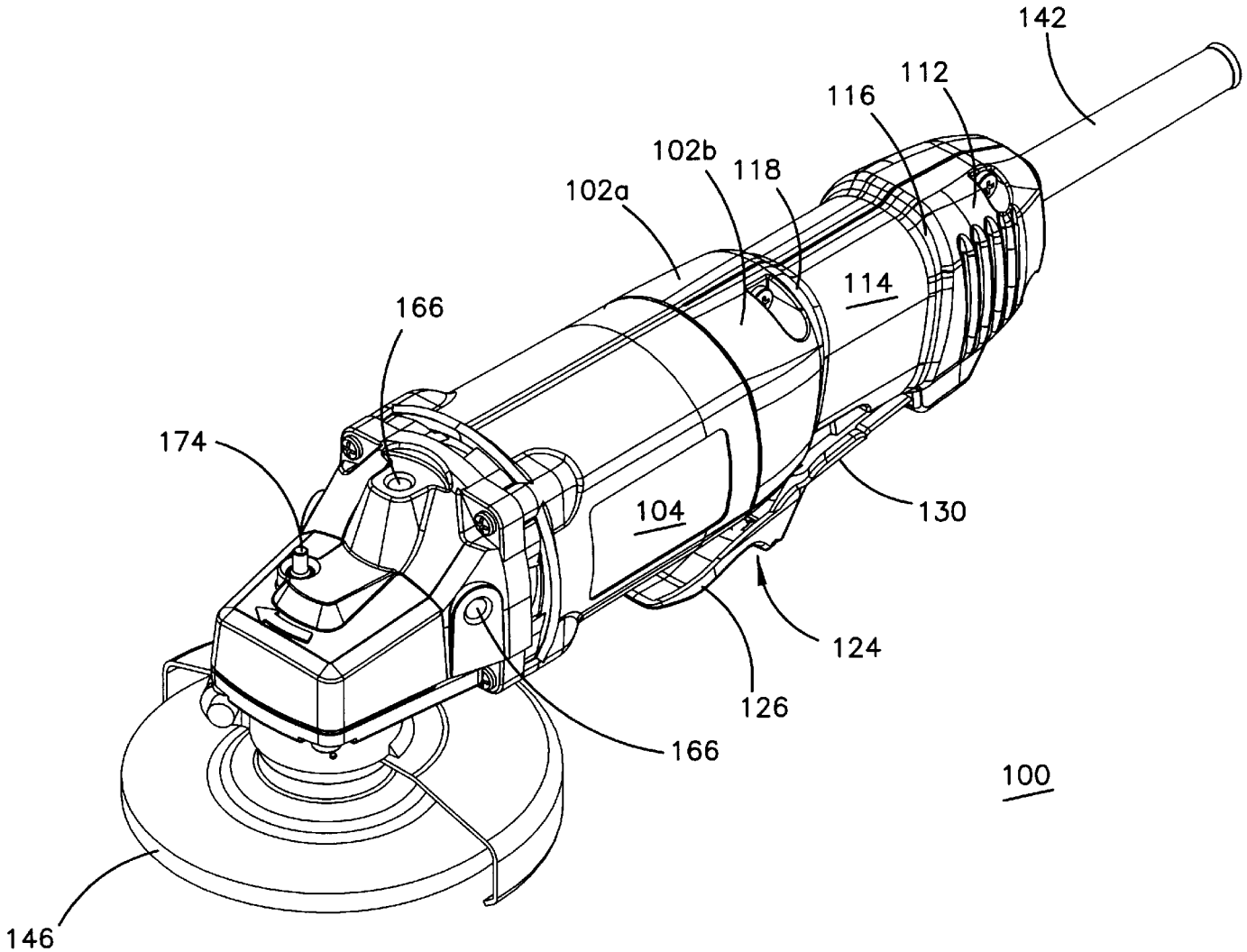
FIG. 3 is a front and top right perspective view of a grinder having a switch paddle in a lowered position.
Figure 5:
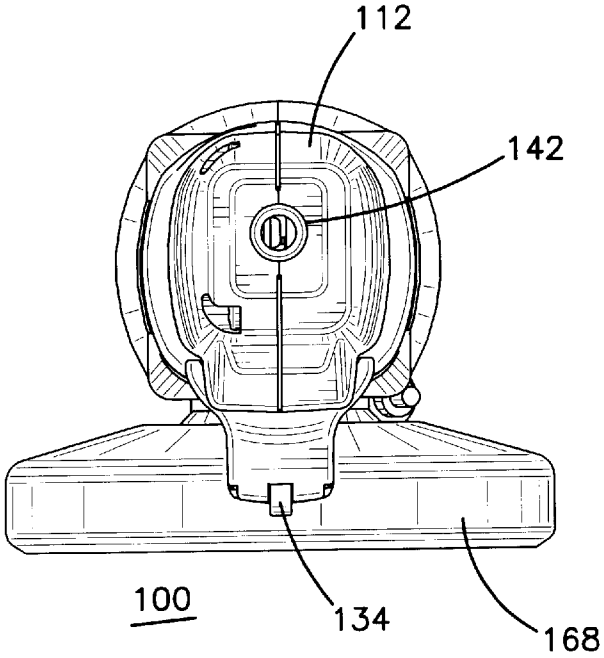
FIG. 5 is a rear elevational view of the grinder shown in FIG. 1.
Figure 4:
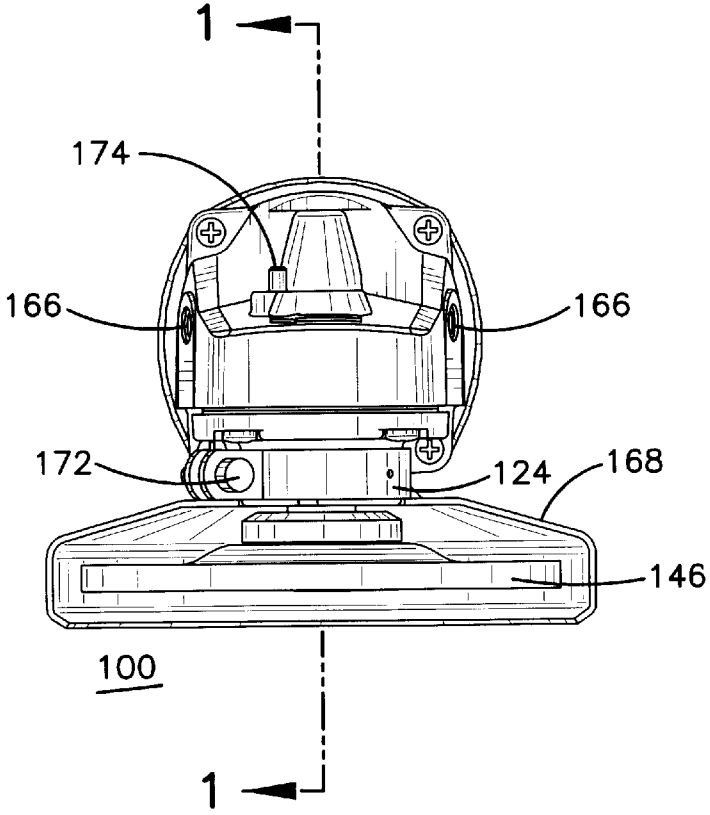
FIG. 4 is a front elevational view of the grinder shown in FIG. 1.
Figure 6:
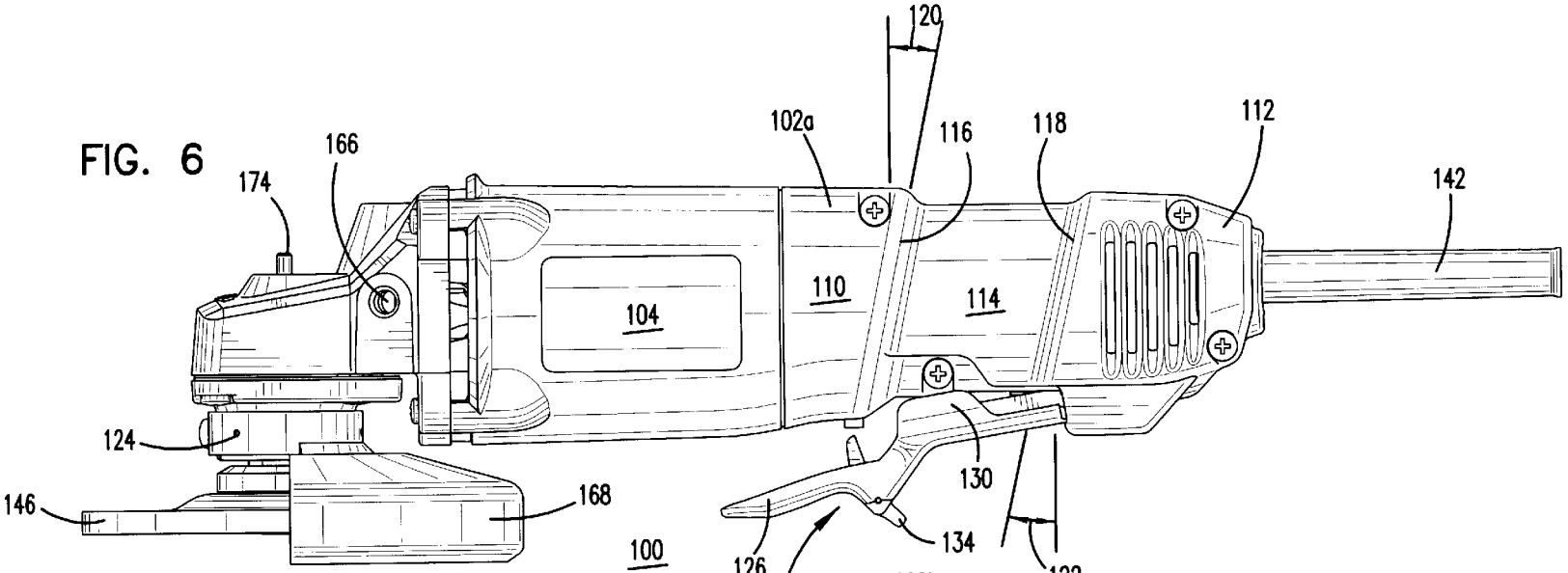
FIG. 6 is a right side elevational view of the grinder shown in FIG. 1.
Figure 7:
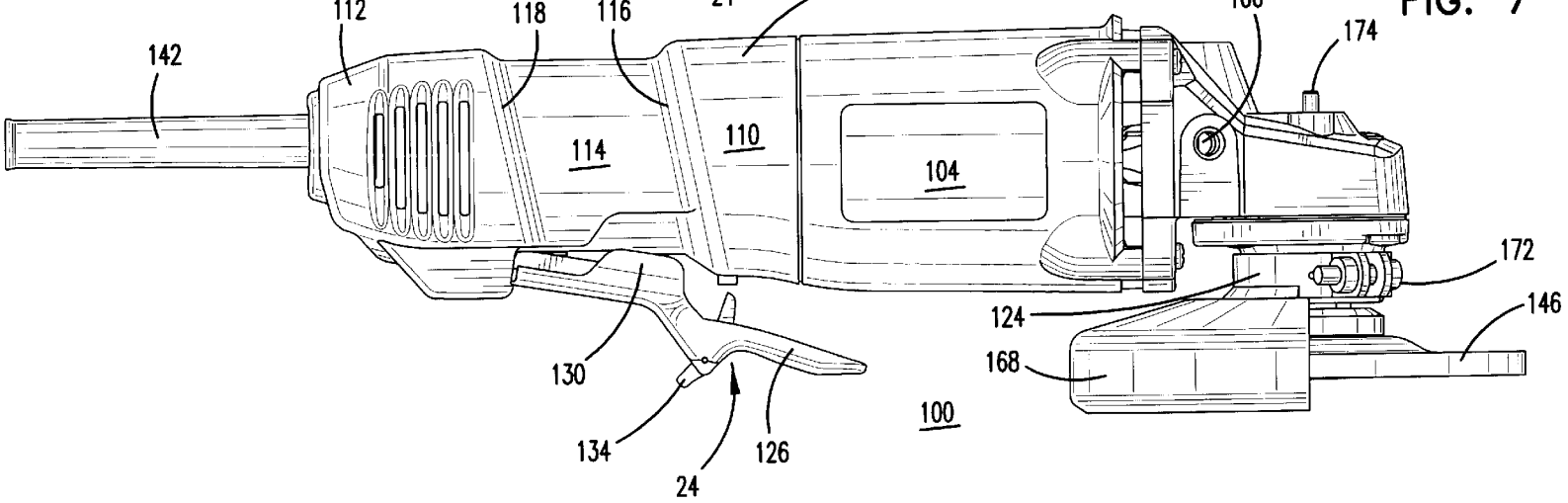
FIG. 7 is a left side elevational view of the grinder shown in FIG. 1.
Figure 8:
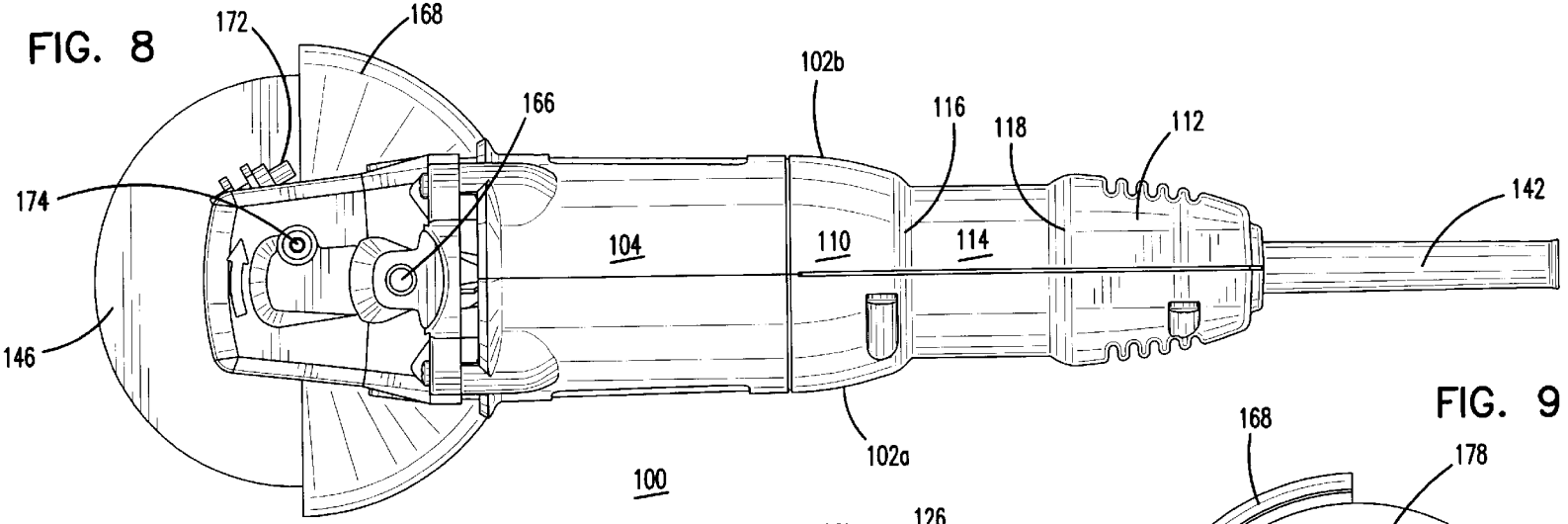
FIG. 8 is a top plan view of the grinder shown in FIG. 1.
Figure 9:
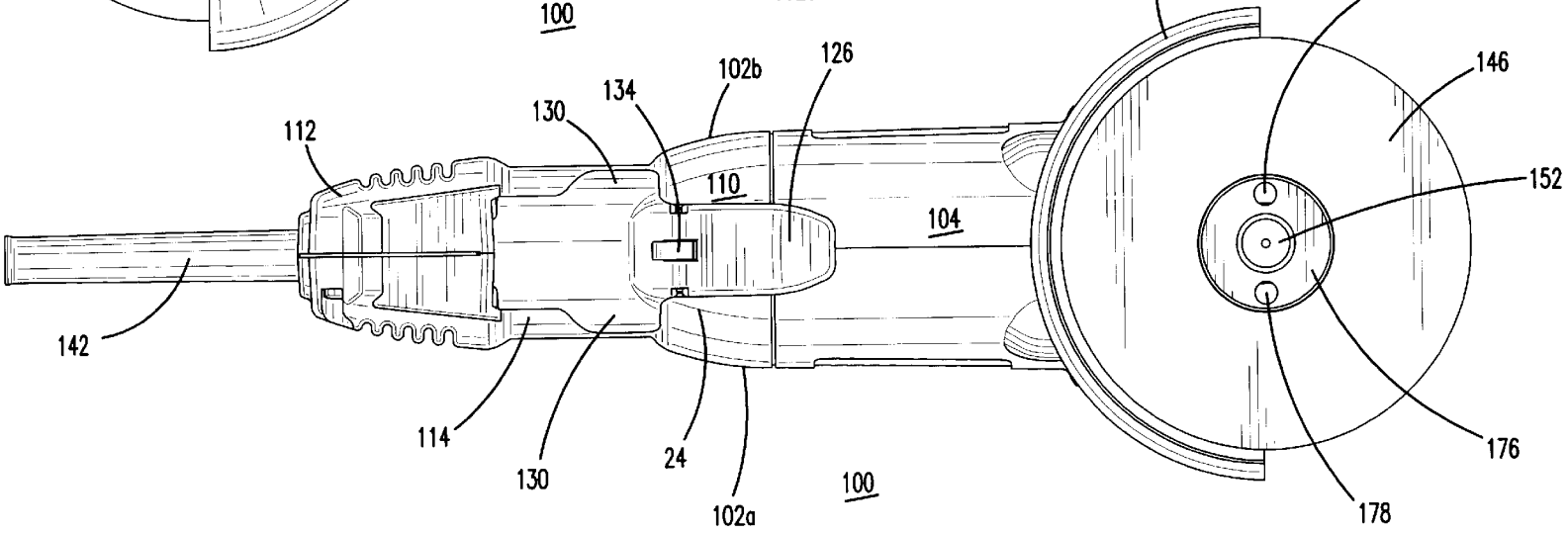
FIG. 9 is a bottom plan view of the grinder shown in FIG. 1.
Figure 10:
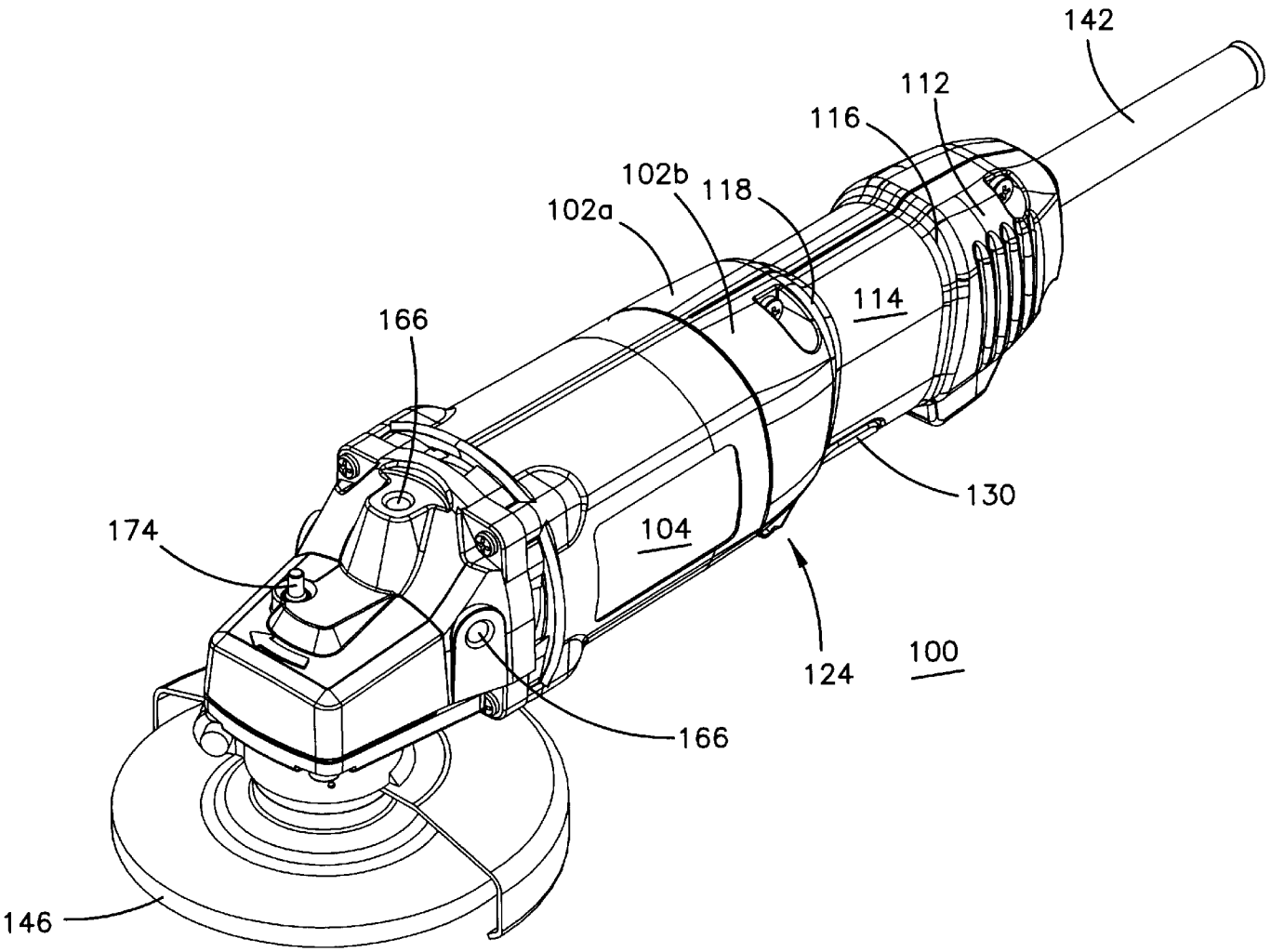
FIG. 10 is a front and top right perspective view of a grinder having a switch paddle in a raised position.
Figure 12:
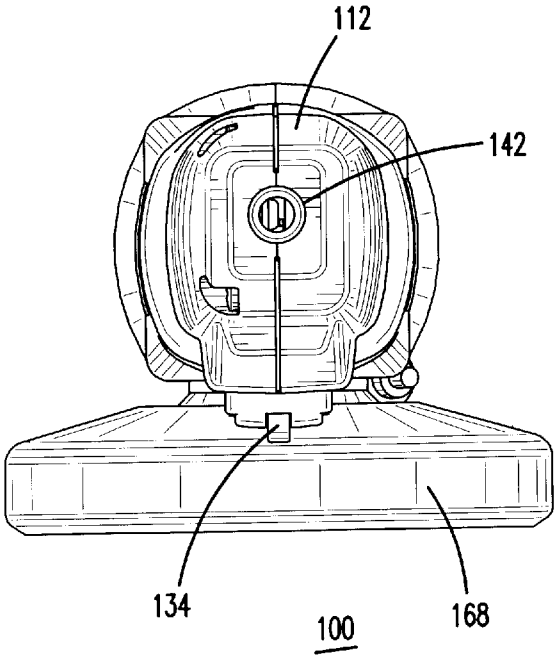
FIG. 12 is a rear elevational view of the grinder shown in FIG. 8.
Figure 11:
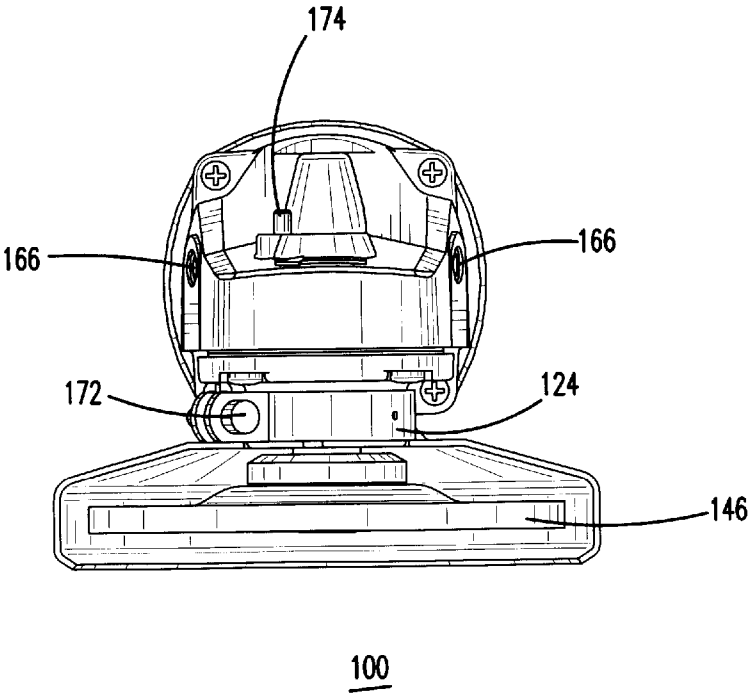
FIG. 11 is a front elevational view of the grinder shown in FIG. 8.
Figure 13:
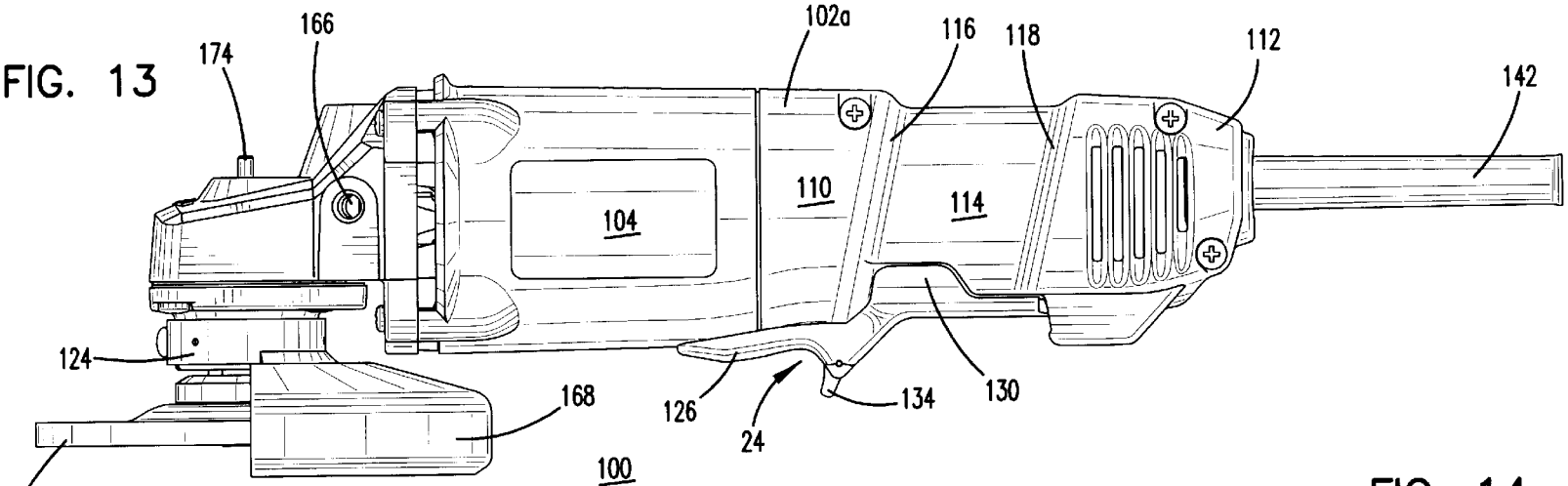
FIG. 13 is a right side elevational view of the grinder shown in FIG. 8.
Figure 14:
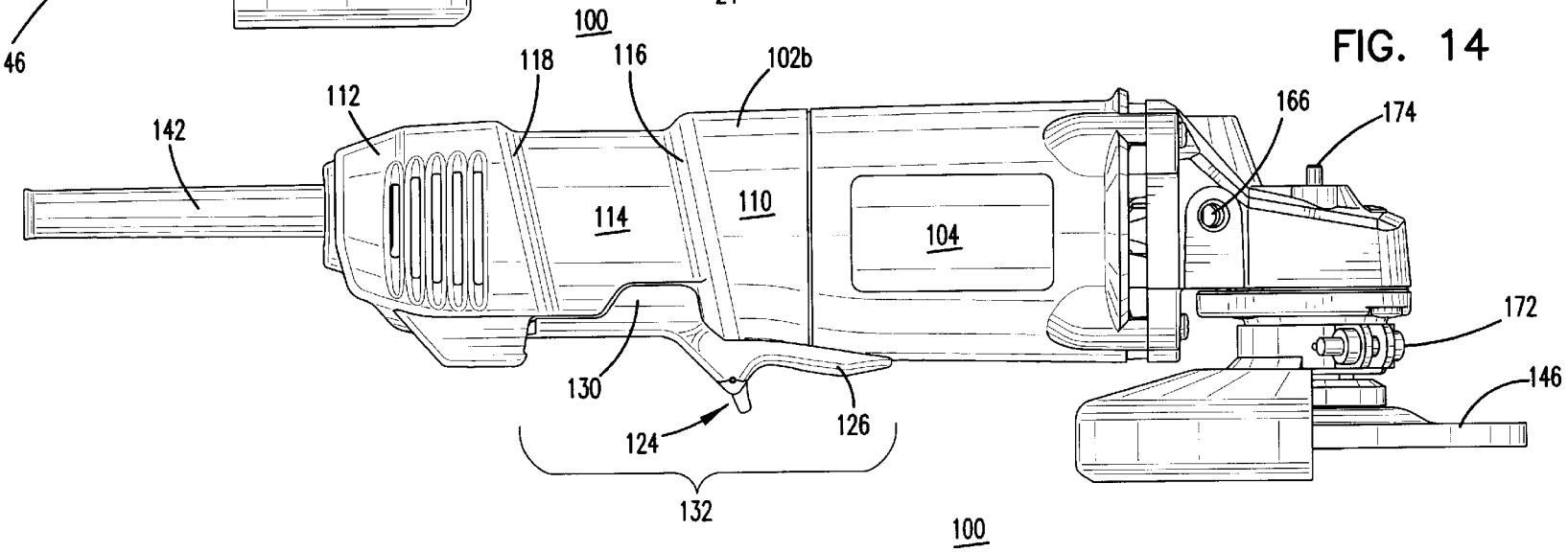
FIG. 14 is a left side elevational view of the grinder shown in FIG. 8.
Figure 15:
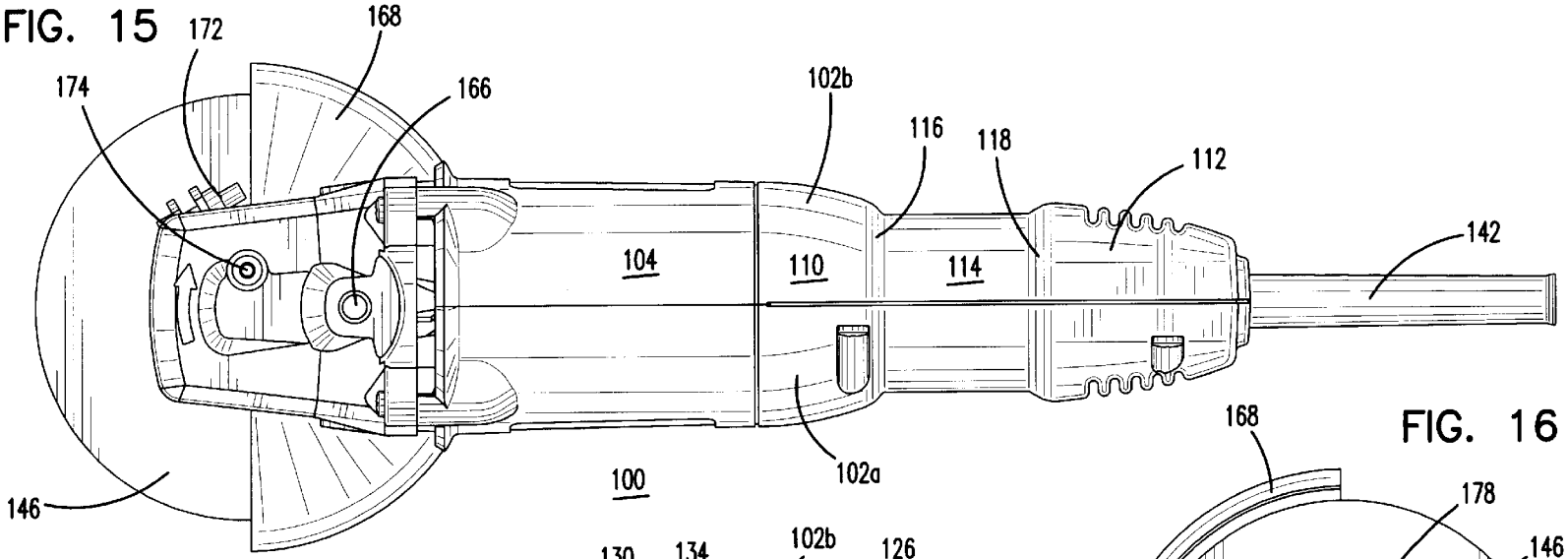
FIG. 15 is a top plan view of the grinder shown in FIG. 8.
Figure 16:
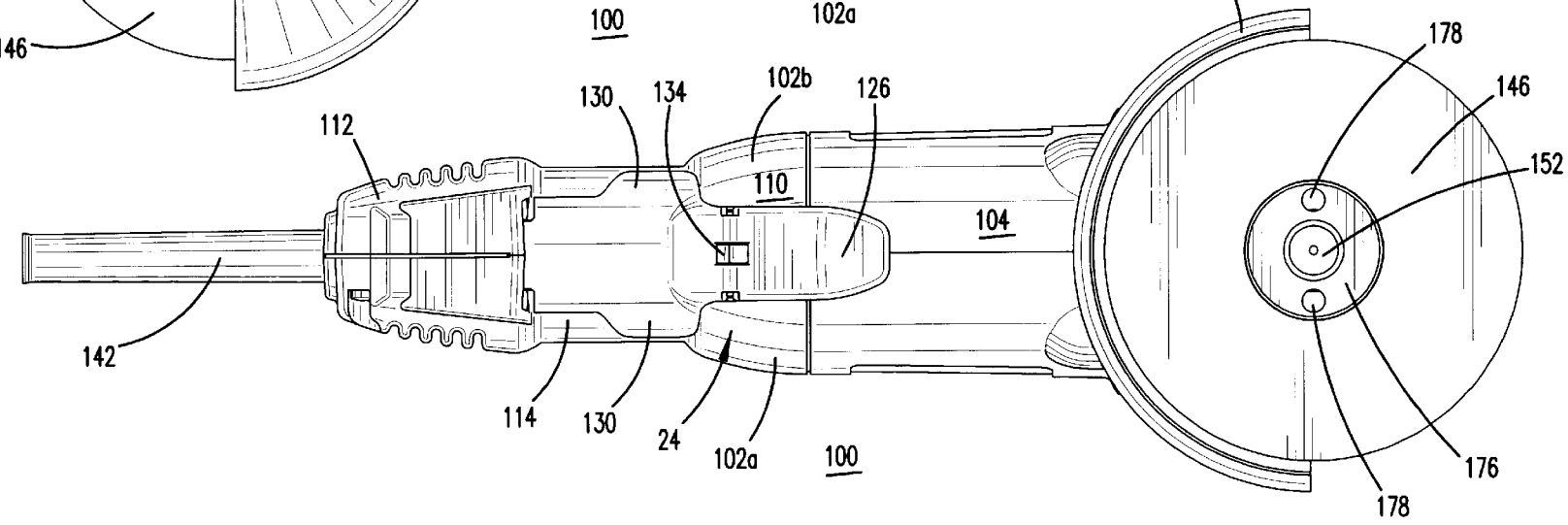
FIG. 16 is a bottom plan view of the grinder shown in FIG. 8.
Figure 17:
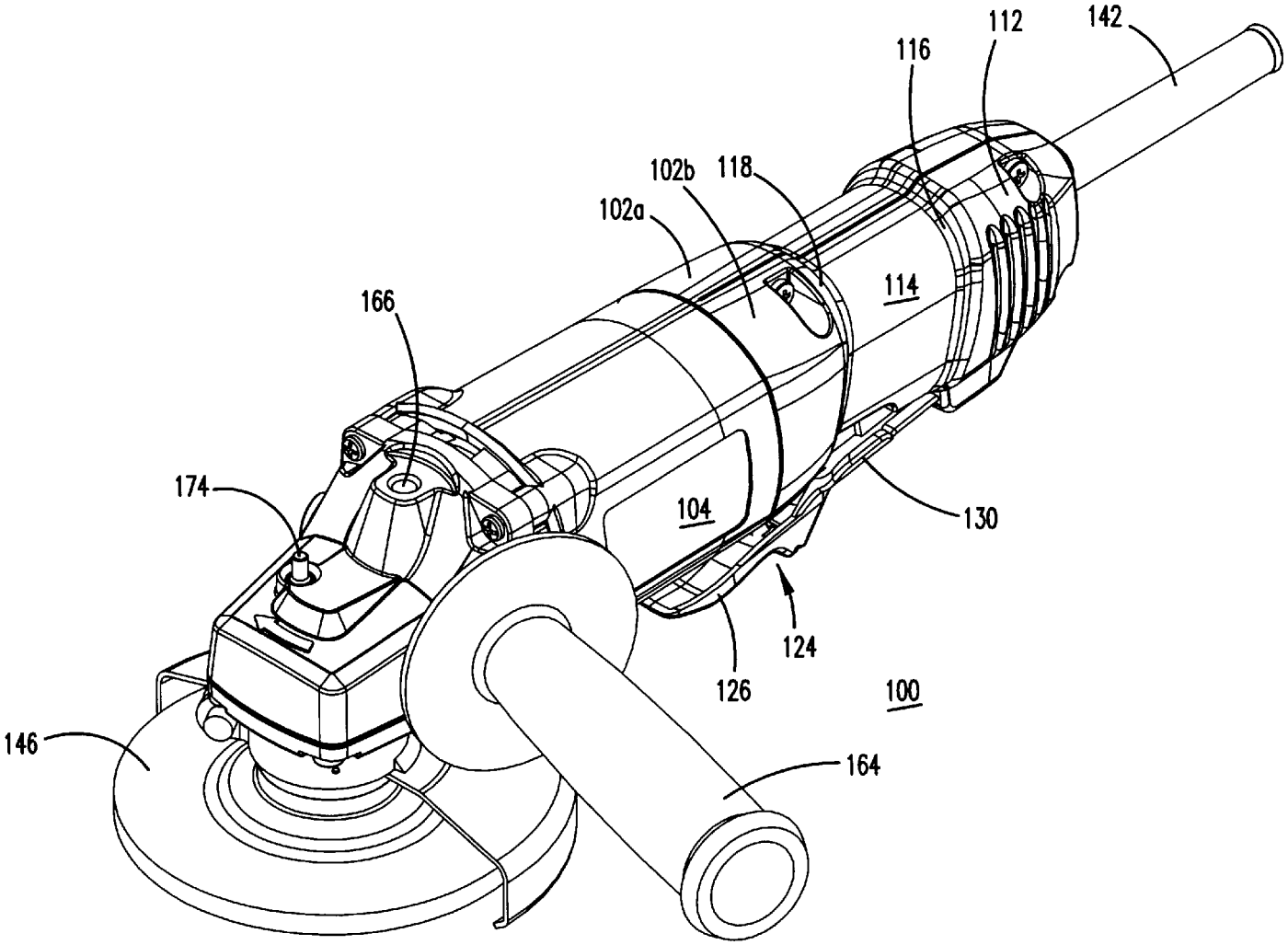
FIG. 17 is a front and top right perspective view of a grinder having a switch paddle in a lowered position and also including an optional side handle.
Figure 18:
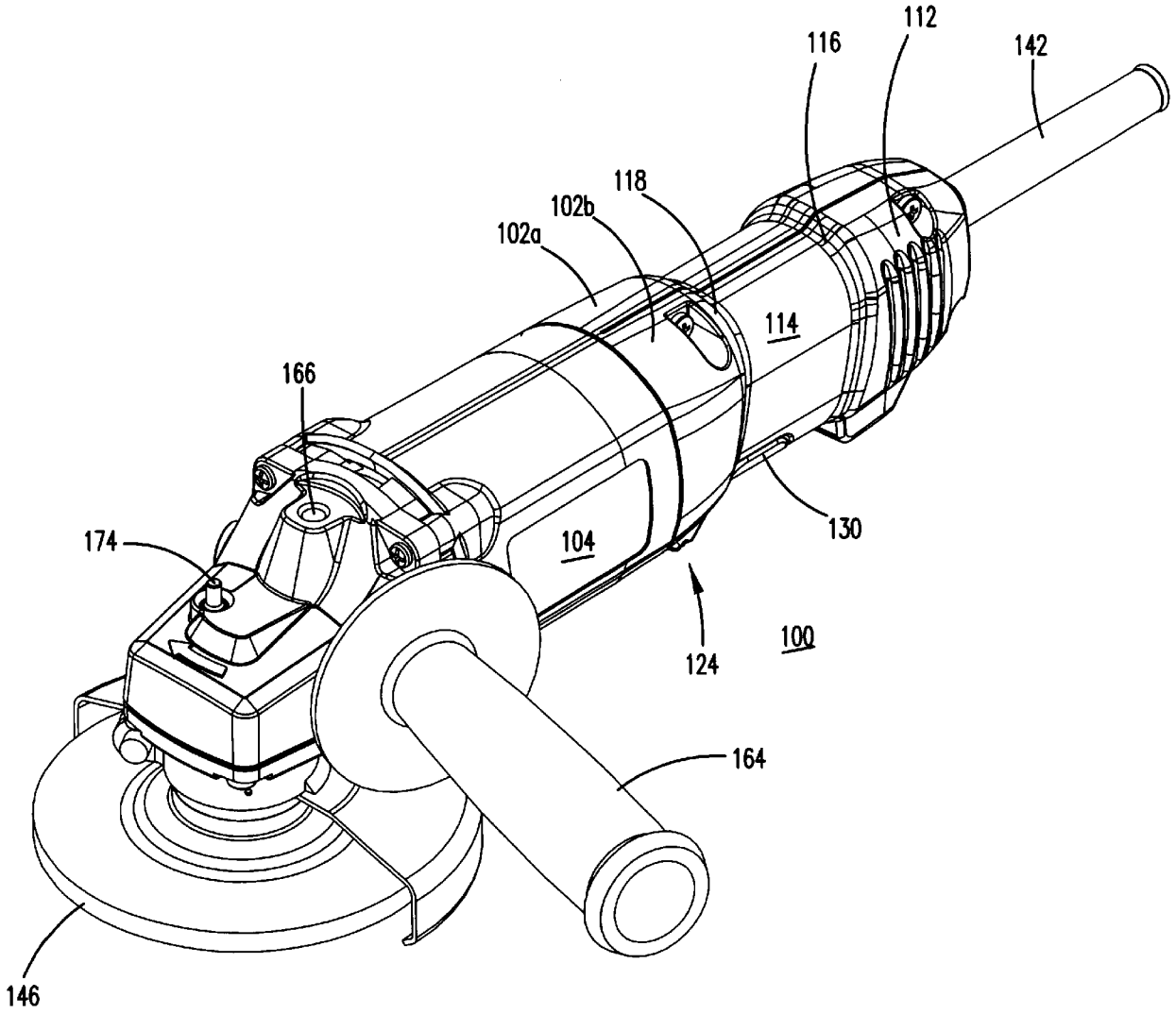
FIG. 18 is a front and top right perspective view of a grinder having a switch paddle in a raised position and also showing an optional side handle.

As is shown in FIG. 2, pivotal movement of switch paddle 126 in the embodiment shown is controlled through pivoting shafts 99*a* and 99*b* on each side of the rear portion of switch paddle 126. These pivoting shafts 99*a* and 99*b* fit within recessed portions or bosses such as boss 98*a* shown on the inside of housing portion 102*a* (a similar boss, not shown, is included inside housing portion 102*b*). As can be seen in FIG. 2, the preferred embodiment shown is formed of two symmetrical halves 102*a* and 102*b* that come together to engage pivoting shafts 99*a* and 99*b* on each side of the paddle switch. Housing halves 102*a* and 102*b* in the embodiment shown are shown held together with machine screws 97.

The forward-most portion of paddle switch 126, the portion forward of finger stop 124, is preferably interfaced with the lower portion of tool handle 102 and/or tool housing 104 such that it is at least partially recessable into the tool handle and/or tool housing or so that, as shown in the Figures, it forms essentially a continuation of the outer shape on the lower side of tool handle 102 and/or tool housing 104, thus further enhancing the ergonomic feel to the user's hand of the present system.

The present invention is to be limited only in accordance with the appended claims, since those skilled in the art may devise many other embodiments in addition to those illustrated and described in the present application. For example, as has previously been indicated, the present tool handle invention may be integrally formed with a grinder tool housing, and either or both of a typical grinder housing or the tool handle may essentially enclose portions of the tool motor.

What is claimed is:

1. An angle grinder, comprising:

a tool housing having an elongated configuration, the housing substantially enclosing a motor having an armature shaft oriented generally parallel to a length of the elongated housing;

an output shaft adapted and configured to receive a grinding disc for rotation in a plane generally parallel to the armature shaft of the motor, the output shaft being located proximate a front end of and being oriented generally perpendicular to the length of the elongated housing, the output shaft extending in a downward direction away from the armature shaft such that the grinding disc is mounted below the tool housing;

a gear train for coupling the motor armature shaft to the output shaft; and the tool housing comprising:

i. a handle body having an elongated shape having front and rear portions defined by the handle body, the handle body having a greater nominal girth proximate the front portion than proximate the rear portion, the handle body having a top side positioned opposite from a bottom side, and the bottom side facing in the downward direction;

ii. a recessed hand grip portion which is defined by the handle body, which is located between the front and rear handle portions, and which transitions inward to a nominal girth smaller than the girth of both the front and rear portions;

iii. the recessed hand grip portion including a leading front wall which transitions from the smaller nominal girth of the hand grip portion toward the larger nominal girth of the front portion, and a trailing back wall which transitions from the smaller nominal girth of the hand grip portion toward the larger nominal girth of the rear portion; and iv. the leading front wall being aligned at an angle which slopes continuously in a forward direction as the leading front wall extends from the top side to the bottom side of the handle body, wherein a bottom portion of the leading front wall located at the bottom side of the handle body is positioned in front of a top portion of the leading front wall located at the top side of the handle body.

2. The angle grinder of claim 1 wherein the handle body is adapted and configured to provide multiple ambidextrous holding positions for a user's hand.

3. The angle grinder of claim 2 wherein the handle and motor housing is adapted and configured to provide a home feel to no fewer than five multiple holding positions of the user's hand.

4. The angle grinder of claim 1 wherein the leading front wall conforms to natural ergonomic grip angles of the user's hand.

5. The angle grinder of claim 1 wherein the leading front wall is formed so that the user's hand can push forward against it.

6. The angle grinder of claim 1 wherein the trailing back wall is defined by the handle body to have an angle which slopes in a downward direction toward the front handle portion.

7. The angle grinder of claim 6 wherein the trailing back wall conforms to natural ergonomic grip angles of the user's hand.

8. The angle grinder of claim 6 wherein the leading front wall and the trailing back wall are substantially parallel to one another.

9. The angle grinder of claim 1 wherein the elongated shape is defined by the handle body to be a slightly-squared cylindrical shape in cross sectional configuration.

10. An angle grinder, comprising:

a tool housing having an elongated configuration, the housing substantially enclosing a motor having an armature shaft oriented generally parallel to the length of the elongated housing;

an output shaft adapted and configured to receive a grinding disc for rotation in a plane generally parallel to the armature shaft of the motor, the output shaft being located proximate a front end of and being oriented generally perpendicular to the length of the elongated housing, the output shaft extending in a downward direction away from the armature shaft such that the grinding disc is mounted below the tool housing;

a gear train for coupling the motor armature shaft to the output shaft;

the tool housing, including a handle body defining front and rear handle portions, the handle body also including an underside positioned opposite from a top side, the underside of the handle body facing in the downward direction;

a switch paddle located beneath the underside of the handle body and being coupled to the handle body by a pivotal connection located proximate the rear handle portion, the switch paddle being pivotally moveable about the pivotal connection in a direction toward the underside of the handle body for activation and use of the tool, the switch paddle including a recessable portion including a pair of upwardly projecting wings configured to straddle the handle body; and the handle body defining, generally along the underside of the handle body between the front and rear handle portions, a recessed hand portion substantially conforming to the shape and thickness of the recessable portion of the switch paddle, the recessed hand portion also defining wing depressions positioned on opposite sides of the handle body for receiving the wings of the switch paddle, wherein the recessable portion of the switch paddle is adapted to fit within the recessed hand portion when the tool is activated and essentially become an integral part of the tool handle as perceived by the feel of a tool-user's hand.

11. The angle grinder of claim 10 wherein the handle body and switch paddle are adapted and configured to provide multiple ambidextrous holding positions for a user's hand.

12. The angle grinder of claim 10 wherein the switch paddle comprises a finger support portion long enough to support essentially all four fingers of a typical user's hand.

13. The angle grinder of claim 10 wherein the switch paddle defines a finger stop section which is located on an underside of the switch paddle and which comprises a generally downwardly facing finger stop protrusion, the finger stop protrusion being oriented generally crosswise to the length of the switch paddle, wherein the user of the tool can selectively place fingers forward or rearward of the finger stop section as part of adjusting the user's hand and finger positions during use of the tool.

14. The angle grinder of claim 13 wherein the protrusion is located approximately at a middle region along a length of the switch paddle.

15. The angle grinder of claim 13 wherein the protrusion comprises a releasable switch lock lever having a locked off position which prevents movement of the switch paddle toward the handle body, the switch lock lever further having an operational position permitting movement of the switch paddle toward the handle body and activation of the tool.

16. The angle grinder of claim 15 wherein the switch lock lever is pivotally coupled to the finger stop protrusion proximate a lower portion of the finger stop protrusion, the switch lock lever comprising an elongated member which in the locked off position protrudes from the pivotal coupling toward the tool handle body and from the pivotal coupling downward from the switch paddle, the switch lock lever being pivotally movable by the user's hand to the operational position permitting movement of the switch paddle toward the handle body and activation of the tool.

17. The angle grinder of claim 10 wherein:

the handle body has a greater nominal girth proximate the front handle portion than proximate the rear handle portion; and a recessed hand grip portion which is defined by the handle body, which is located between the front and rear handle portions, and which transitions inward to a nominal girth smaller than the girth of both the front and rear handle portions.

18. An angle grinder, comprising:

a tool housing having an elongated configuration, the housing substantially enclosing a motor having an armature shaft oriented generally parallel to the length of the elongated housing;

an output shaft adapted and configured to receive a grinding disc for rotation in a plane generally parallel to the armature shaft of the motor, the output shaft being located proximate a front end of and being oriented generally perpendicular to the length of the elongated housing, the output shaft extending in a downward direction away from the armature shaft such that the grinding disc is mounted below the tool housing;

a gear train for coupling the motor armature shaft to the output shaft; and the tool housing including a handle body defining front and rear handle portions;

a switch paddle coupled to the handle body by a pivotal connection located proximate the rear handle portion, the switch paddle being pivotally moveable about the pivotal connection in a direction toward the handle body for activation and use of the tool, the switch paddle defining a finger stop section which is located on an underside of the switch paddle that faces in the downward direction and which comprises a generally downwardly extending protrusion, the protrusion being oriented generally crosswise to the length of the switch paddle, the protrusion being sized and shaped for fully supporting a finger of the user, wherein the user of the tool can selectively place fingers forward or rearward of the finger stop section as part of adjusting the user's hand and finger positions during use of the tool.

19. The angle grinder of claim 18 wherein the switch paddle comprises a finger support portion long enough to support essentially all four fingers of a typical user's hand.

20. The angle grinder of claim 19 wherein the protrusion is located approximately at a middle region along a length of the finger support portion.

21. The angle grinder of claim 18 wherein the protrusion comprises a releasable switch lock lever having a locked off position which prevents movement of the switch paddle toward the handle body, the switch lock lever further having an operational position permitting activation of the tool.

22. The angle grinder of claim 21 wherein the switch lock lever is pivotally coupled to the finger stop protrusion proximate a lower portion of the finger stop protrusion, the switch lock lever comprising an elongated member which in the locked off position protrudes from the pivotal coupling toward the tool handle body and from the pivotal coupling downward from the switch paddle, the switch lock lever being pivotally movable by the user's hand to the operational position permitting movement of the switch paddle toward the handle body and activation of the tool.

23. An angle grinder, comprising:

a tool housing having an elongated configuration, the housing substantially enclosing a motor having an armature shaft oriented generally parallel to the length of the elongated housing, and the tool housing forming a handle having front and rear handle portions;

an output shaft adapted and configured to receive a grinding disc for rotation in a plane generally parallel to the armature shaft of the motor, the output shaft being located proximate a front end of and being oriented generally perpendicular to the length of the elongated housing, the output shaft extending in a downward direction away from the armature shaft such that the grinding disc is mounted below the tool housing;

a gear train for coupling the motor armature shaft to the output shaft; and a switch paddle for activating and de-activating the motor, the switch paddle being located generally under the handle and coupled to the handle by a pivotal connection located proximate the rear handle portion, the switch paddle being pivotally moveable about the pivotal connection in a direction toward the handle for activation and use of the tool, and the switch paddle including a finger support portion long enough to support essentially all four fingers of a typical user's hand, the switch paddle also including a finger stop protrusion that projects downwardly from the finger support portion, the finger stop protrusion being located at an intermediate position along a length of the finger support portion, and the finger stop protrusion being formed by first and second surfaces that concurrently extend in the downward direction and converge toward one another, and a releasable switch lock lever pivotally mounted at the finger stop protrusion at a location between the first and second converging surfaces, the switch lock lever having a locked off position which prevents movement of the switch paddle toward the handle body, and the switch lock lever further having an operational position permitting activation of the tool.

24. The grinder of claim 23, wherein the handle forms a recessed hand grip portion located between the front and rear handle portions and having a reduced girth as compared to the front and rear handle portions.

25. The grinder of claim 24, wherein the switch paddle extends forward from the pivotal connection such that at least a portion of the switch paddle is located directly below the recessed hand grip portion.

26. The grinder of claim 25, wherein the handle defines a switch paddle recess adapted for receiving the switch paddle, the switch paddle recess being configured such that when the switch paddle is fully depressed, the switch paddle fits within the switch paddle recess and becomes essentially an integral part of the tool handle.

27. The grinder of claim 24, wherein the front handle portion has a larger girth than the rear handle portion.

28. The grinder of claim 24, wherein the recessed hand grip portion is at least partially defined by a leading wall and a trailing wall, the leading and trailing walls including side portions having directional components that extend in a longitudinal direction along the handle.

29. The grinder of claim 28, wherein the side portions of the leading and trailing walls are substantially parallel.

* * * * *